US009062875B2

(12) United States Patent
Neal

(10) Patent No.: US 9,062,875 B2
(45) Date of Patent: Jun. 23, 2015

(54) LED LIGHT SOURCE

(71) Applicant: Andrew T. Neal, Salt Point, NY (US)

(72) Inventor: Andrew T. Neal, Salt Point, NY (US)

( * ) Notice: Subject to any disclaimer, the term of this patent is extended or adjusted under 35 U.S.C. 154(b) by 15 days.

(21) Appl. No.: 13/986,373

(22) Filed: Apr. 25, 2013

(65) Prior Publication Data

US 2014/0321108 A1 Oct. 30, 2014

(51) Int. Cl.

| | |
|---|---|
| ***F21V 31/00*** | (2006.01) |
| ***F21K 99/00*** | (2010.01) |
| *F21V 5/04* | (2006.01) |
| *F21W 131/103* | (2006.01) |
| *F21Y 101/02* | (2006.01) |
| *F21Y 111/00* | (2006.01) |

(52) U.S. Cl.

CPC ..... *F21V 31/005* (2013.01); *F21V 5/04* (2013.01); *F21K 9/30* (2013.01); *F21W 2131/103* (2013.01); *F21Y 2101/02* (2013.01); *F21Y 2111/001* (2013.01)

(58) Field of Classification Search

CPC ..... F21K 9/175; F21K 9/50; F21V 23/005; F21V 31/005; F21V 9/04

USPC ..... 362/235, 373, 294, 249.02

See application file for complete search history.

(56) References Cited

U.S. PATENT DOCUMENTS

| | | | | |
|---|---|---|---|---|
| 6,234,649 | B1 * | 5/2001 | Katougi | 362/248 |
| 6,857,756 | B2 * | 2/2005 | Reiff et al. | 362/184 |
| 6,979,100 | B2 * | 12/2005 | Reiff et al. | 362/184 |
| 7,641,361 | B2 * | 1/2010 | Wedell et al. | 362/240 |
| 7,661,854 | B1 * | 2/2010 | Yang et al. | 362/373 |
| 7,682,036 | B2 | 3/2010 | Reiff et al. | |
| 7,972,036 | B1 * | 7/2011 | Schach et al. | 362/290 |
| 8,092,045 | B2 * | 1/2012 | Xiao et al. | 362/249.02 |
| 8,403,528 | B2 * | 3/2013 | Bacon | 362/241 |
| 8,414,153 | B2 * | 4/2013 | Barta | 362/249.02 |
| 8,596,821 | B2 * | 12/2013 | Brandes et al. | 362/249.02 |
| 2012/0127743 | A1 * | 5/2012 | Hoetzl et al. | 362/396 |
| 2012/0218757 | A1 | 8/2012 | Gill | |
| 2012/0319620 | A1 | 12/2012 | Vigilante et al. | |
| 2013/0016510 | A1 * | 1/2013 | Sanders et al. | 362/235 |
| 2014/0240990 | A1 * | 8/2014 | Bae | 362/294 |

* cited by examiner

*Primary Examiner* — Anabel Ton
(74) *Attorney, Agent, or Firm* — Joseph L. Spiegel

(57) ABSTRACT

An LED light source includes a plurality of longitudinal extrusions arranged in an array, the extrusions having an upper and lower end, an interior longitudinal slot, and outside longitudinal grooves. A printed circuit board is fitted and supported within the extrusion slots and has wiring. A plurality of LEDs is connected in series to the wiring, spacedly mounted along the board. High frequency electronic driver means is connected in series to the LEDs on the printed circuit boards and adapted to be further connected to a DC power source. A power supply for connection to and converting available AC to DC, is connected to the driver means. Lenses have ends fitted within the extrusion grooves, the lenses spaced from and covering the printed circuit boards and LEDs thereon. Upper and lower end caps are affixed to the upper and lower ends of the extrusions, respectively, and hold the printed circuit boards and lenses in place. A means is provided for connecting the light source to an external fixture. The driver means and power supply may be positioned within the extrusion array. Water and dirt resistant seals may be placed on the upper and lower end caps, a plug holding the upper seal in place and a disc positioned beneath the lower seal for preventing damage to same.

7 Claims, 7 Drawing Sheets

LED LIGHT SOURCE

BACKGROUND OF THE INVENTION

1. Field of the Invention

This invention relates to a light source either as a retrofit for use in such lighting fixtures as streetlamps that use metal halide or sodium lamps, or as a stand-alone unit and wherein the light source includes a plurality of LEDs.

2. Description of the Prior Art

It is known to provide light sources either as retrofits for use in existing, in-place lighting fixtures or as stand-alone units and wherein the light source includes LEDs. An example may be found in U.S. Pat. No. 8,356,911 to Neal, issued Jan. 22, 2013.

What is most desirable is a light source that utilizes ultra low power, has very high output, is a universal retrofit, but also can be a stand-alone unit, and these are among the objects of the present invention.

SUMMARY

These and other objects, features and advantages are accomplished in accordance with the teachings of the present invention, one illustrative embodiment of which comprises an LED light source with a plurality of longitudinal extrusions arranged in an array, the extrusions having an upper and lower end, an interior longitudinal slot, and outside longitudinal grooves. A printed circuit board is fitted and supported within the extrusion slots and has wiring. A plurality of LEDs is connected in series to the wiring, spacedly mounted along the board. High frequency electronic driver means is connected in series to the LEDs on the printed circuit boards and adapted to be further connected to a DC power source. A power supply for connection to and converting available AC to DC, is connected to the driver means. Lenses have ends fitted within the extrusion grooves, the lenses spaced from and covering the printed circuit boards and LEDs thereon.

Upper and lower end caps are affixed to the upper and lower ends of the extrusions, respectively, and hold the printed circuit boards and lenses in place. A means is provided for connecting the light source to an external fixture. The driver means and power supply may be positioned within the extrusion array. Water and dirt resistant seals may be placed on the upper and lower end caps, a plug holding the upper seal in place and a disc positioned beneath the lower seal for preventing damage to same.

BRIEF DESCRIPTION OF THE DRAWING

Other objects, features and advantages of the present invention will be apparent from the following detailed description and accompany drawing, wherein.

DETAILED DESCRIPTION

Figure 1:
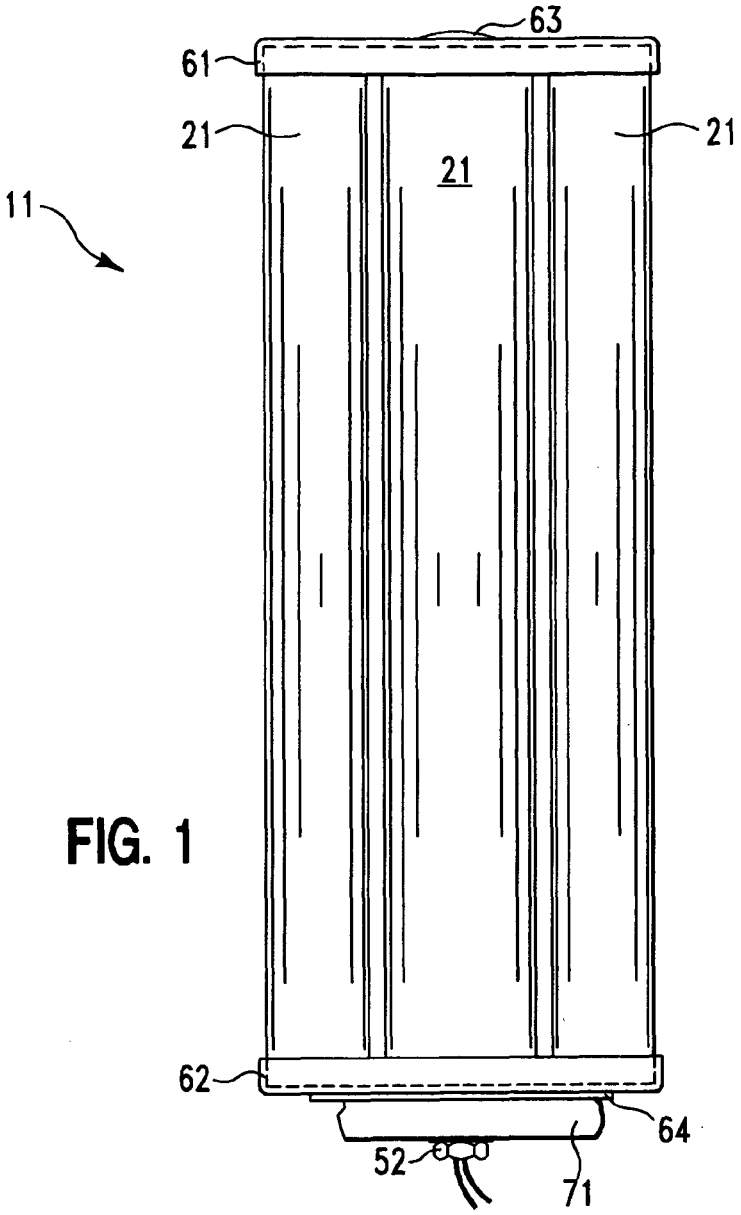
FIG. 1 is a front view of the light source of the present invention.
Figure 2:
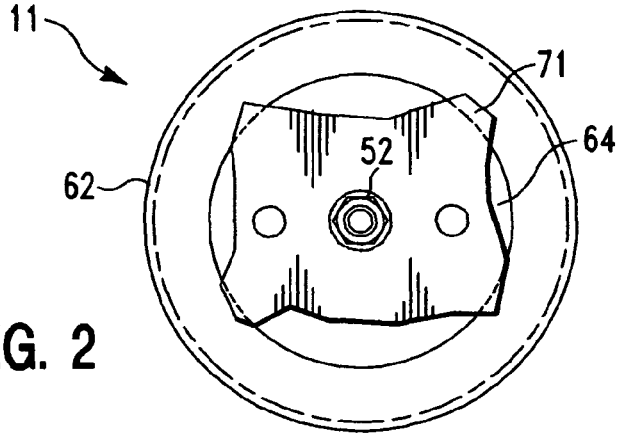
FIG. 2 is a bottom view of the light source of FIG. 1, partially cut away.
Figure 3:
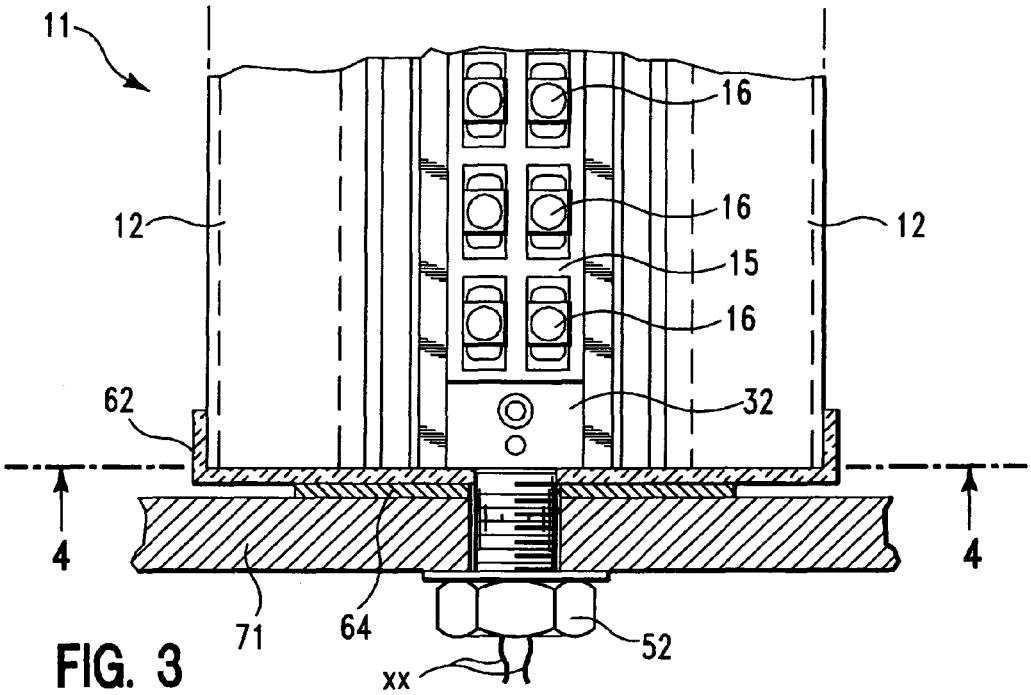
FIG. 3 is sectional view of the bottom portion of the light source.

Referring now to the drawing a light source is shown, constructed in accordance with teachings of the present invention. The light source 11 (FIGS. 1 and 4) is seen as having a plurality of longitudinal extrusions or shells 12 (in the embodiment shown, six), typically aluminum and, as shown, in a circular array and having upper and lower ends. The extrusions 12 are structural members forming the frame for the light source 11. A circular array is preferable for any application that requires 360 degree light distribution, but other arrangements are possible. The extrusions also act as heat sinks.

Figure 4:
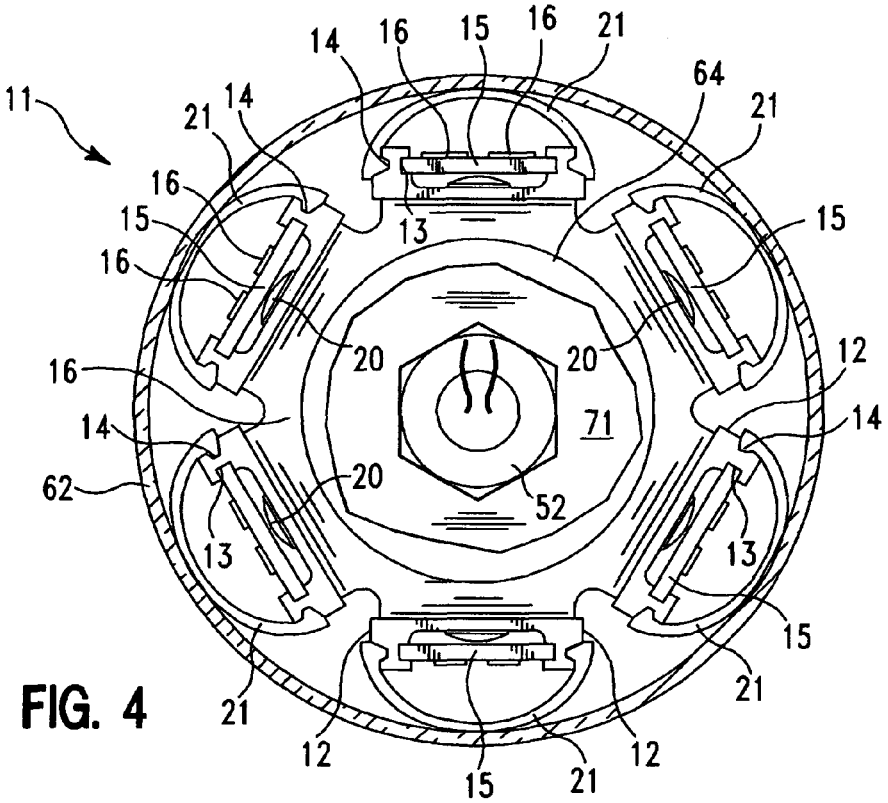
FIG. 4 is a bottom view, taken along the lines 4-4 of FIG. 3.
Figure 5:
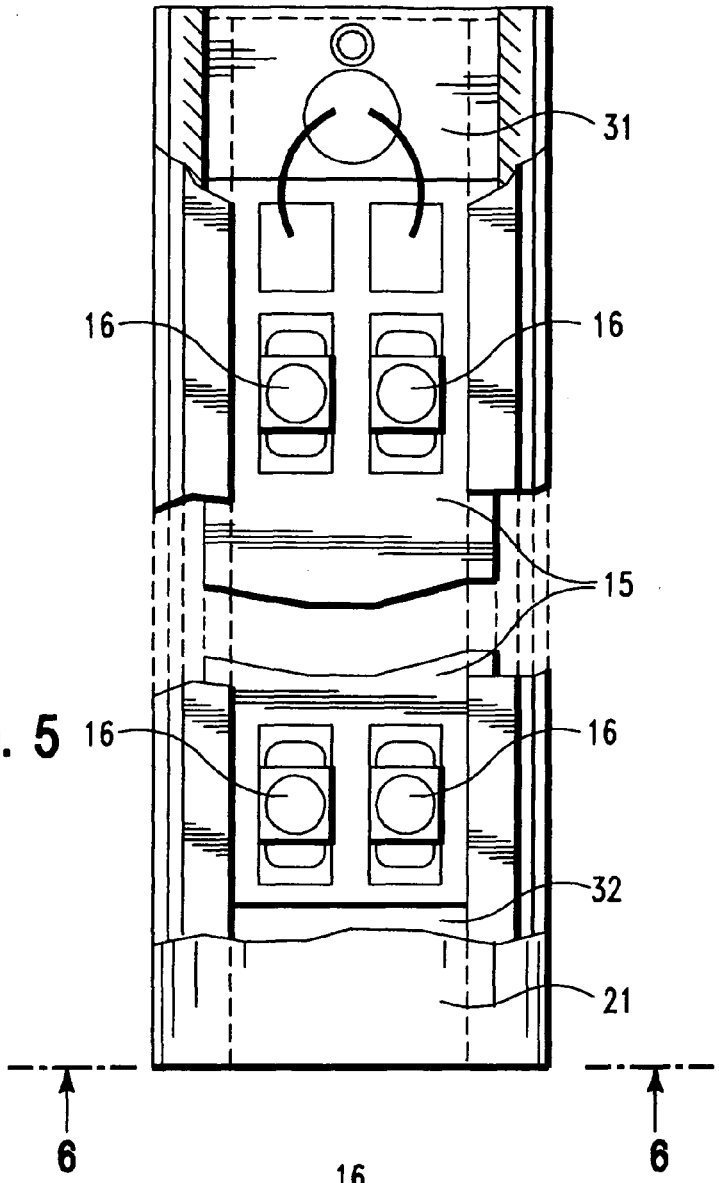
FIG. 5 is an enlarged, partial front view of an extrusion, supporting an LED bearing circuit board.
Figure 6:
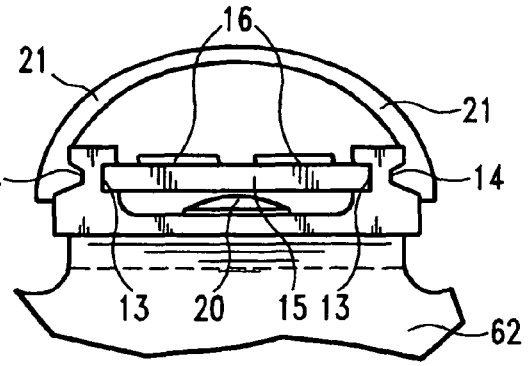
FIG. 6 is a sectional view taken along the lines 6-6 of FIG. 5.

Each extrusion has a longitudinal, interior slot 13 and outside groves 14 (FIG. 4).

A printed circuit board 15 is fitted and supported within the slot 13 of each extrusion 12. Slot 13 locates the board 15 and stops the board from moving side-to-side. Glue, sealant or a small piece of PCB material may be used to hold the board 15 in place. The boards 15 are provided with some form of longitudinally extending, laterally spaced wiring that may be embedded within the board 15, or on their upper surface.

A plurality of LEDs 16 is connected in series across the laterally spaced wiring, the LEDs spacedly mounted along the board.

The length of the boards 15 can vary, but typically they are twelve inches in length.

On a 12 inch board there are typically seventy two LEDs mounted thereon.

Figures 7, 8, 9:
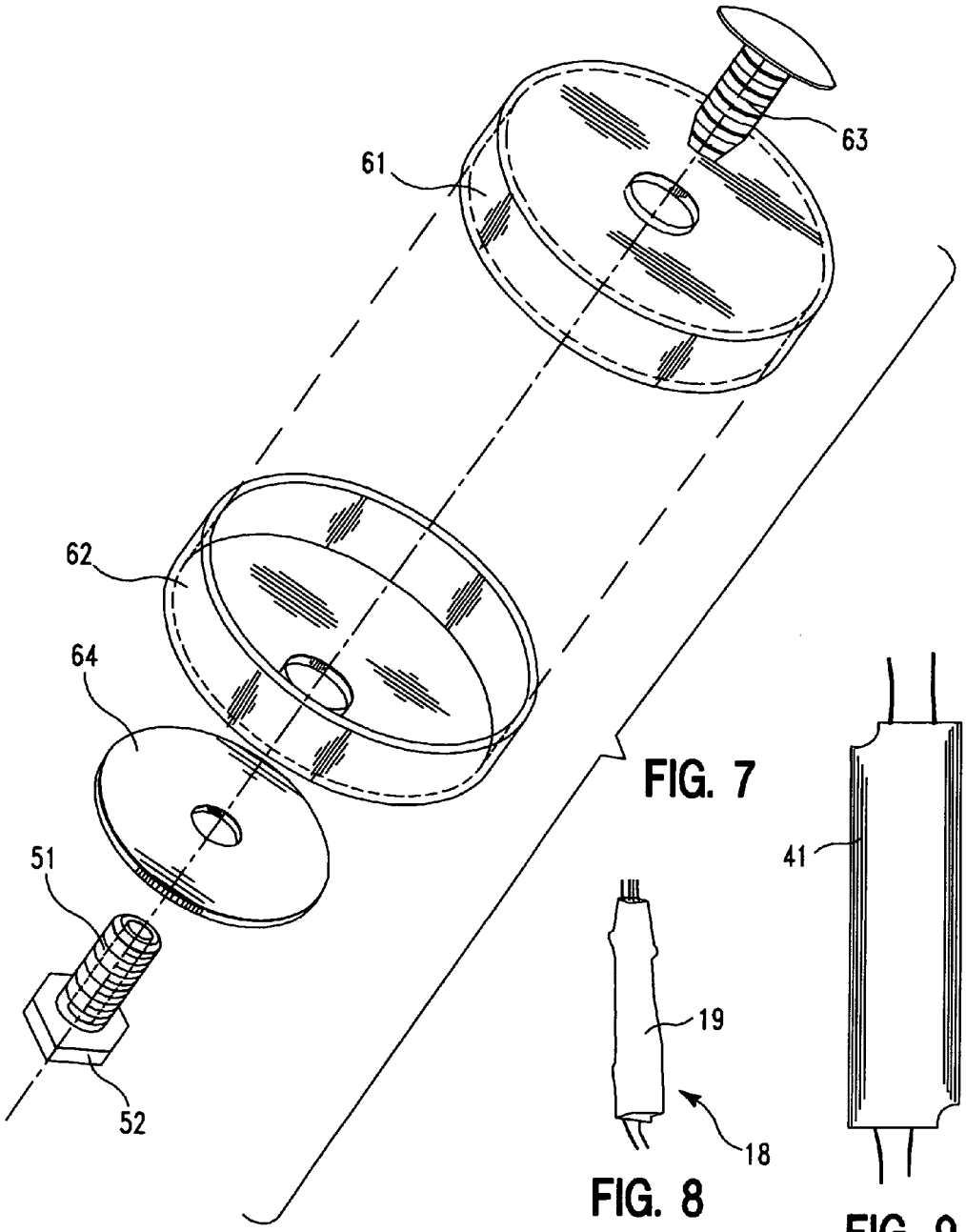
FIG. 7 is an enlarged, exploded view showing only the top plug, top vinyl cap, lower vinyl cap, disc and mounting bolt.
FIG. 8 is a side view of electronic driver used in the light source.
FIG. 9 is a side view of a converter used in the present invention.
Figure 10:
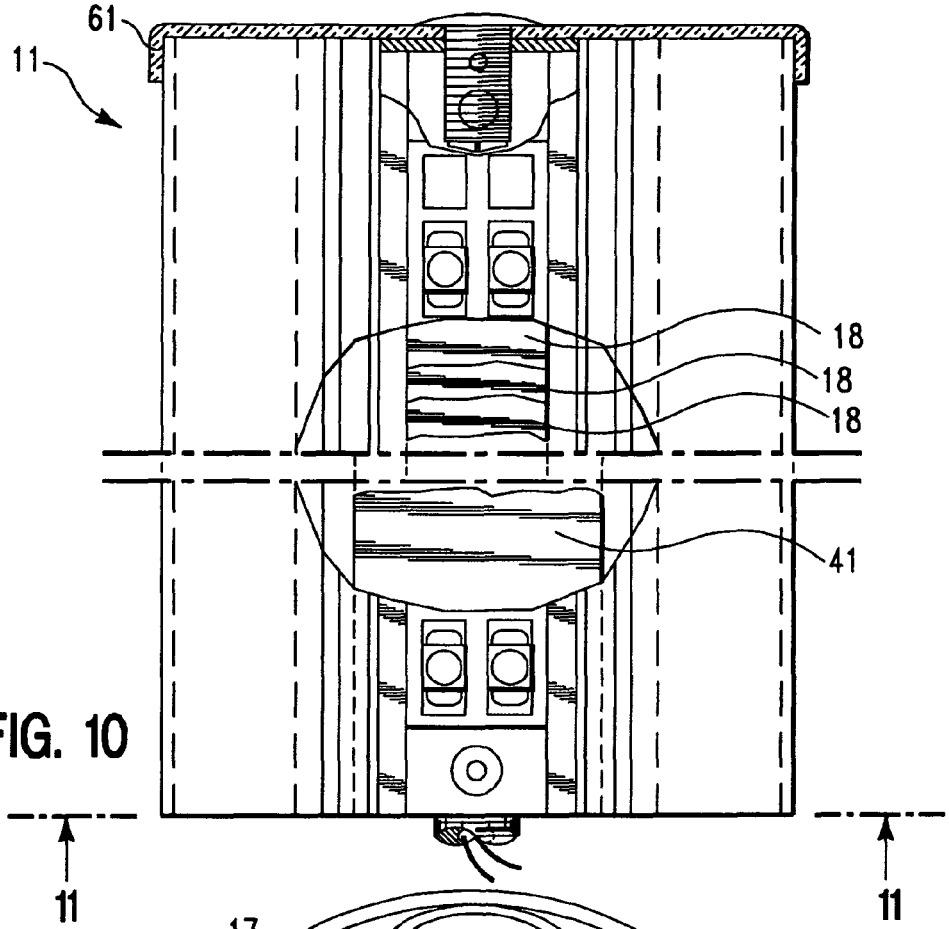
FIG. 10 is a side sectional view, partially broken away, of the light source.
Figure 11:
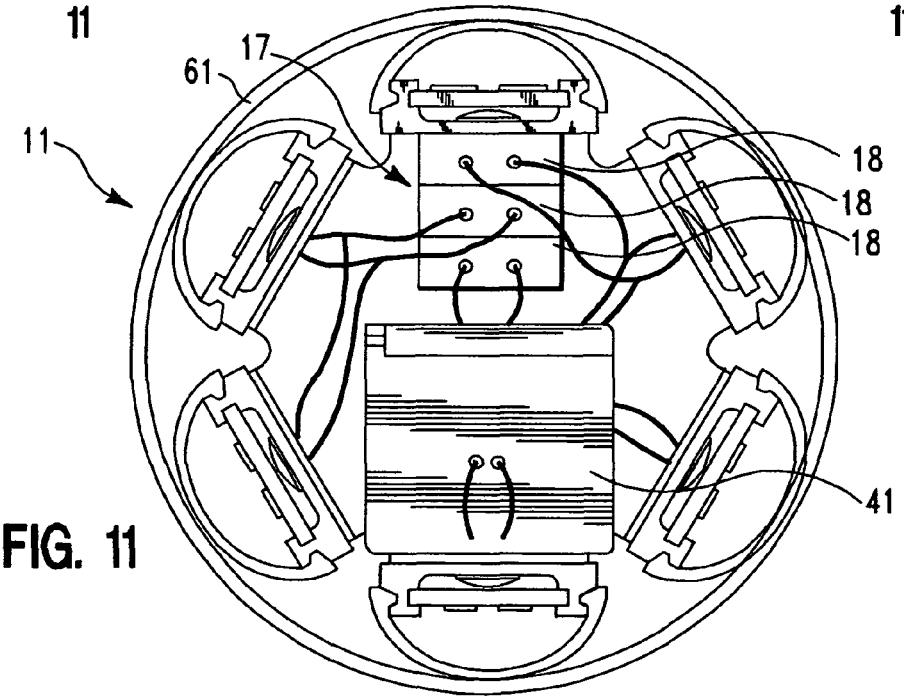
FIG. 11 is a sectional view taken along the lines 11-11 of FIG. 10.

The light source 11 is provided with high frequency electronic driver means 17 (FIG. 11). The driver means 17 controls the drive current to the LEDs from their DC supply and ensures that the LEDs reach their maximum life and maintain steady light output. In the embodiment shown there are three drivers 18 positioned within the array of extrusions 12. For an array of six extrusions with six LED bearing circuit boards, there are three drivers, each driver connected at one end by flexible wires to contacts at the ends of two circuit boards and the opposite ends, joined together and connected to power by wire. Typically, a driver 18 is housed within heat shrink, insulated tubing 19 (FIG. 8). The light source 11 is further provided with voltage limiting devices 20, typically zener diodes, located on the backside of the boards 15 connected to the wiring in parallel with the LEDs 16, one device 20 per LED 16.

The light source 11 is provided with curved lenses 21 covering the LED bearing circuit boards 15. The ends of the lenses slide into the two outside grooves 14 in the extrusions 12, in such manner as to space the lenses 21 from the LED circuit boards 15. The lenses 21 distribute light evenly across a field and may be made of UV resistant, high strength polycarbonate material.

Figure 12:
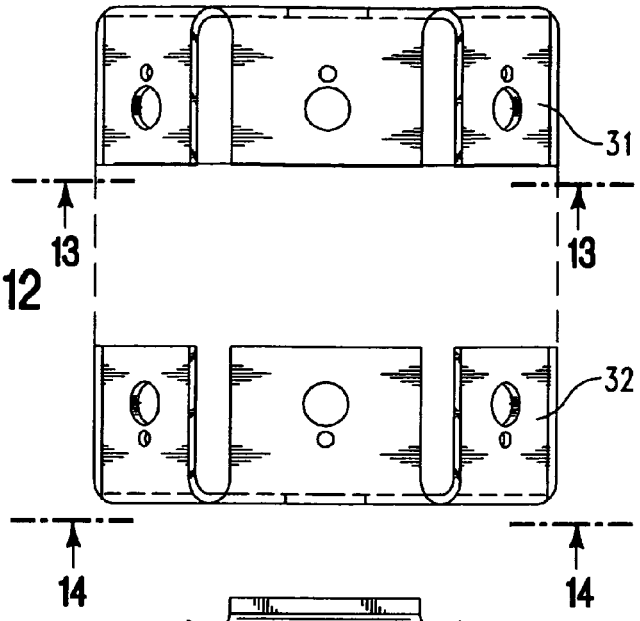
FIG. 12 is a side view showing the upper and lower extrusion caps.
Figure 13:
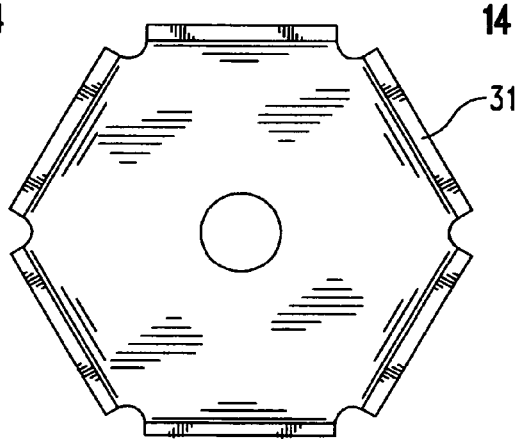
FIG. 13 is a sectional view taken along the lines 13-13 of FIG. 12.
Figure 14:
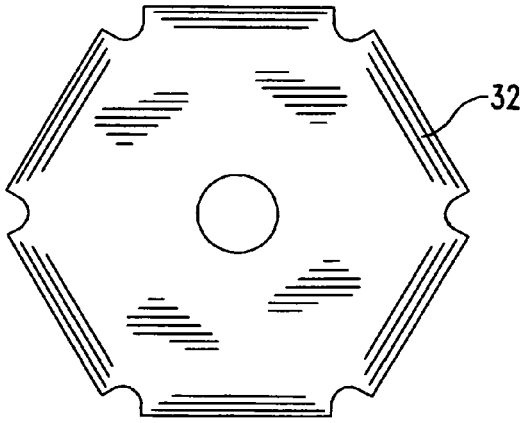
FIG. 14 is a sectional view taken along the lines 14-14 of FIG. 12.

The light source 11 is provided with upper 31 and lower 32 hexagonal folded aluminum end caps (FIGS. 12 and 13) riveted to the upper and lower ends of the extrusions 12, respectively. The end caps 31, 32 provide stability to the structure of the light source 11 and serve to hold the printed circuit boards 15 and lenses 21 in place.

The light source 11 may include a power supply 41 (FIGS. 9 and 11) connected to the driver means 17 for converting available AC to DC required by the LEDs. The power supply 41 may be mounted within the extrusion array, as shown. Placement of both the driver means 17 and power supply 41 within the array allows for a very compact and self contained unit with one power connection. The preferred output of the power supply 41 is twenty four VDC, although it could vary from twelve to forty eight volts and much higher with changes in the driver circuitry.

The light source is further provided with means for connecting to an existing fixture such as a streetlamp. The connection means includes a mounting bolt 51 for connecting to an existing streetlamp fixture. The mounting bolt 51 is hollow to allow for passage of wiring from the power supply 41 to the available AC. A nut threaded 52 on the bolt 51 holds the bolt 51 in place.

The light source 11 may also be provided with dirt and resistant end seals 61, 62 on the upper and lower extrusion end caps 31, 32 (FIG. 7). The seals 61, 62 may be made of, for example, rubber or vinyl. The seals 61, 62 prevent dirt and moisture from getting into the circuit boards 15.

In this embodiment, a plug 63 is provided that holds the upper seal 61 in place and is of the same diameter as the mounting bolt 51 on the bottom. The mounting bolt 51 will pass through the lower seal 62.

Removal of the plug 61 allows one to remove the upper seal and gain quick access to the LED bearing boards.

Also, a large diameter disc 64 is provided beneath the lower seal 62 that prevents the bottom seal 62 from being damaged. The nut 52 holds the disc 64, the base of the light source 11 and the seal 62 in place and disc 64 prevents the seal 62 from being crushed by the tightening of the nut 52 by spreading the load.

In the assembly of this embodiment, the circuit boards 15 are slid into place. Five of the extrusions 12 are riveted to the end caps 31, 32. The bottom seal 62, mounting bolt 51, disc 64 and nut 52 are fitted to the bottom end cap 32. The drivers 18 are wired to the circuit boards 15 and the wires from the power supply 41 are crimped onto the drivers 18 and the power supply opposite wires then run through the mounting bolt 51. The final extrusion 12 is riveted into place, the lenses fitted to the extrusions 12 and the top seal 61 and plug 63 are then fitted to the upper end cap 31.

Figure 15:
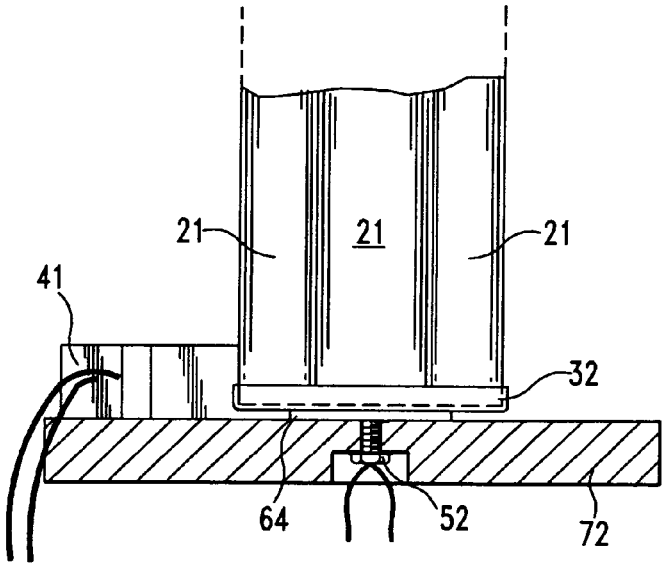
FIG. 15 is sectional view, partially cut away, of an alternate embodiment of the present invention where the converter is mounted on a lower plate; and, FIG. 16 is a sectional view taken along the lines 15-15 of FIG. 14.
Figure 16:
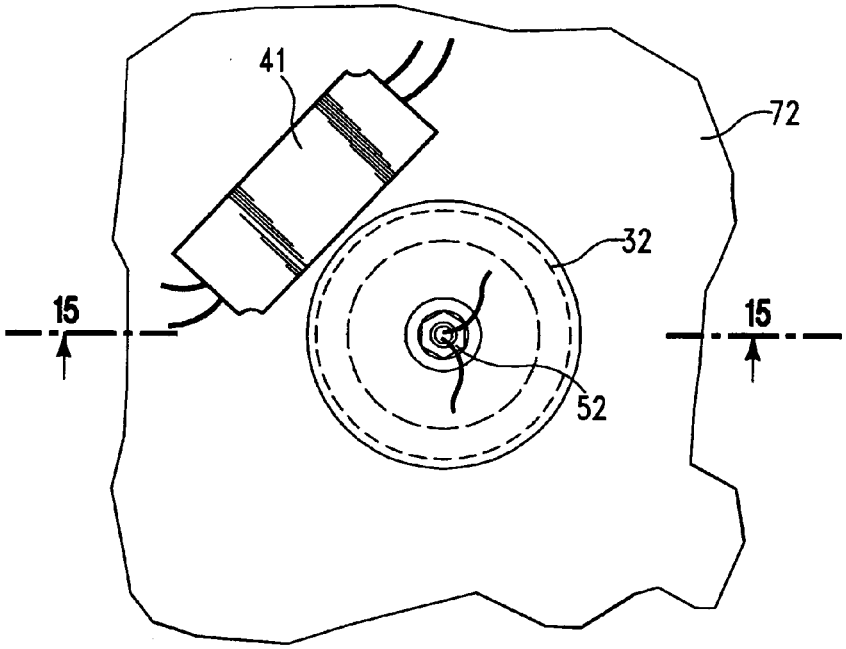

In an alternate embodiment, and as shown in FIGS. 15 and 16, where, for example, the light source is to be used in a streetlamp, the source is further provided with a plate 71 for mounting within the streetlamp. The plate 71 could be rectangular, square or circular depending upon the configuration of the streetlamp and its interior dimensions. The plate 71 is threaded on the mounting bolt 51 and held in place by a second nut 72. In this embodiment, the power supply 41 can be fastened onto the plate 71, as by pop rivets, sheet metal screws and washers, a regular nut and bolt and the like.

The light source is of compact design, a little over three inches in diameter. It is very efficient in terms of power consumption, 36 watts for a six extrusion unit source, compared to 175 watts for an existing halide or sodium lamp that it would replace. The compact size of the source, leads to an intense, less diffuse light, more closely simulating the light from the unit it replaces.

The light source is an integrated unit. One doesn't need multiple pieces to replace the previous existing unit.

The light source can also be used as a stand-alone fixture mounted directly to a junction box or gang box screwed into same via a threaded bushing, or even arranged in an array hung from an overhead fixture to provide large area overhead illumination.

Besides metal halide and sodium lamps the light source of the present invention can replace all discharge lamps, incandescent, CFL, fluorescent, etc.

The design is not limited to a six sided array, it could be any multiple, depending on the application. The length can also vary depending on the application from a few inches through several feet.

Thus, in one light source we utilize ultra low power, the source has very high output, is a universal retrofit, but also can be a stand-alone unit. It will go into the space provided for a metal halide or sodium lamp and meets or exceed their light output at a fraction of the power. It is a low cost energy alternative to conventional metal halide or sodium lamps. Any existing fixture can be retrofitted with this light source.

It should be obvious that changes, additions and omissions may be made in the details and arrangement of parts without departing from the spirit and scope of the invention as hereinafter claimed.

What is claimed is:

1. An LED light source comprising:

a plurality of longitudinal extrusions arranged in an array, the extrusions having
an upper and lower end
an interior longitudinal slot, and
outside longitudinal grooves;

a printed circuit board fitted and supported within the extrusion slots and having wiring on the board;

a plurality of LEDs connected in series to the wiring, spacedly mounted along the board;

high frequency electronic driver means connected in series to the LEDs on the printed circuit boards and adapted to be further connected to a DC power source;

the driver means positioned within the extrusion array, includes multiple electronic drivers, each driver means connected to the LEDs on at least a pair of printed circuit boards, the driver means being housed within heat shrink insulated tubing;

a power supply for connection to and converting available AC to DC, connected to the driver means;

lenses having ends fitted within the extrusion grooves, the lenses spaced from and covering the printed circuit boards;

upper and lower end caps affixed to the upper and lower ends of the extrusions, respectively, and holding the printed circuit boards and lenses in place; and, means for connecting the light source to an external fixture.

2. The light source according to claim 1 including a disc positioned against and beneath the lower seal for preventing damage to the lower seal.

3. The light source according to claim 1 wherein the means for connecting the light source to an external fixture includes a hollow bolt through which wiring from a power supply may pass.

4. The light source according to claim 3 including a nut holding the bolt in place.

5. The light source according to claim 4 wherein a plate is threaded to the connection bolt and a second nut holds the plate in place.

6. The light source according to claim 5 wherein the power supply is fastened onto the plate.

7. The light source according to claim 1 including water and dirt resistant caps on the upper and lower end caps and a removable plug holding the upper seal in place.

* * * * *